United States Patent [19]

Pesch

[11] Patent Number: 4,973,224

[45] Date of Patent: Nov. 27, 1990

[54] IMPELLER-AND-SEAL UNIT FOR LIQUID PUMPS

[75] Inventor: Klaus Pesch, Leverkusen, Fed. Rep. of Germany

[73] Assignee: Goetze AG, Burscheid, Fed. Rep. of Germany

[21] Appl. No.: 370,843

[22] Filed: Jun. 23, 1989

[30] Foreign Application Priority Data

Jun. 24, 1988 [DE] Fed. Rep. of Germany ..... 3821352

[51] Int. Cl.[5] ..... F04D 29/08

[52] U.S. Cl. ..... 415/174.3; 277/22; 277/84; 277/88; 277/93 SD

[58] Field of Search ..... 415/174.2, 174.3, 177, 415/170.1; 277/22, 26, 88, 93 R, 93 SD, 84, 85

[56] References Cited

U.S. PATENT DOCUMENTS 3,354,529 11/1967 James .
3,474,733 10/1969 Saletzki et al. ..... 415/174.3
3,594,102 7/1971 Oden ..... 277/96
4,413,831 11/1983 Washida et al. ..... 277/85
4,548,547 10/1985 Deuring ..... 415/174.3
4,779,876 10/1988 Novosad ..... 277/26
4,842,286 6/1989 Heilala ..... 277/85
4,854,598 8/1989 Deuring ..... 277/93 SD

FOREIGN PATENT DOCUMENTS 3706770 9/1988 Fed. Rep. of Germany .

*Primary Examiner*—John T. Kwon
*Attorney, Agent, or Firm*—Spencer & Frank

[57] ABSTRACT

An impeller-and-seal unit for a liquid pump includes a plastic impeller, a metal hub affixed to the impeller and arranged to receive and contact a pump shaft, a slide ring seal assembly including a slide ring and a counterring received in a recess of the impeller and being in sliding contact with the slide ring. The metal hub has a radial extension which projects radially outwardly and which is received in the recess, forming a bottom thereof. The counterring has a radial end face which is in a direct contact with the radial extension.

3 Claims, 1 Drawing Sheet

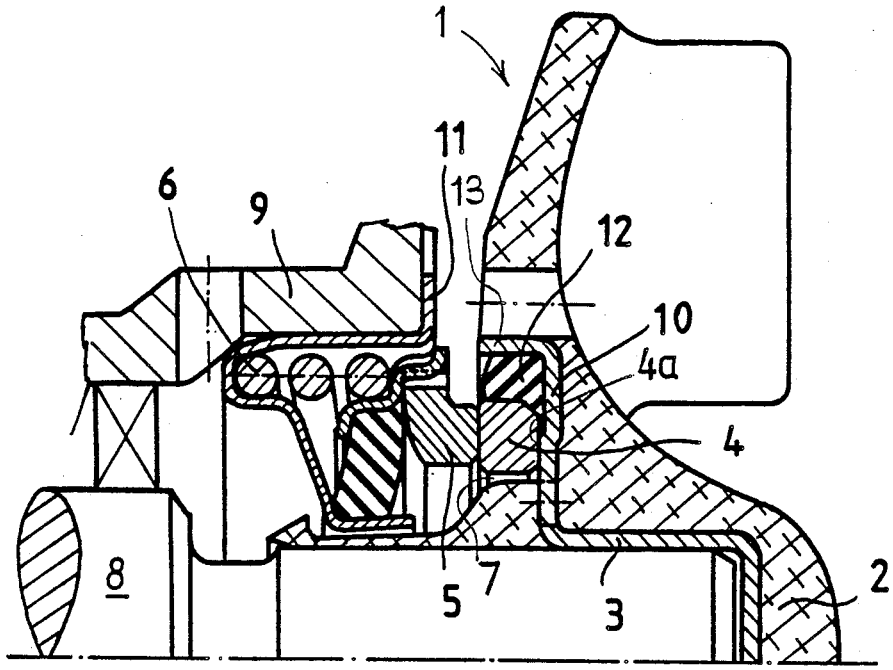
1
11
13
6
9
12
10
4a
4
8
5
7
3
2

IMPELLER-AND-SEAL UNIT FOR LIQUID PUMPS

BACKGROUND OF THE INVENTION

This invention relates to an impeller-and-seal unit which forms part of a liquid pump and which includes a plastic impeller connected to the pump shaft by a metal hub. The unit further has a slide ring seal (mechanical seal) assembly comprising a counterring cooperating with the impeller as well as a coupling body which axially holds all components together.

Liquid pumps which have an impeller made of a synthetic material and combined with a slide ring seal assembly are widely used in automotive vehicles for driving the coolant through the engine. In pumps of this type problems are encountered in that at high temperatures there is a risk that the plastic material of the impeller melts, resulting in a breakdown of the system. In addition to the coolant temperature, the heat generated by the contacting and relatively rotatable components of the slide ring seal assembly is also an important factor.

An impeller-and-seal unit outlined above is disclosed, for example, in U.S. Pat. No. 3,594,102. The plastic impeller described therein has a metallic hub inserted on the pump shaft, and the counterring of the slide ring seal assembly is press-fitted into an opening provided in the plastic impeller.

During operation, the friction heat generated between the contacting and relatively rotating components has to be reduced. While the stationary slide ring is exposed to the liquid to be sealed, whereby a sufficient amount of heat removal and thus temperature reduction occurs, the rotary counterring is only capable of transmitting the heat to the coolant through the narrow gap it forms with the stationary slide ring sliding surfaces and to the rear side of the plastic impeller. This arrangement leads to a partial melting of the impeller.

SUMMARY OF THE INVENTION

It is an object of the invention to provide an improved impeller-and-seal unit of the above-outlined type which, in particular, eliminates the problem of heat accumulation inherent in prior art constructions.

This object and others to become apparent as the specification progresses, are accomplished by the invention, according to which, briefly stated, the counterring is received in a recess of the impeller whose bottom is formed by a radially outwardly projecting extension of the metal hub.

The above-outlined construction ensures that the counterring is in a heat-conducting contact with the metal hub, so that the friction heat may be led away from the counterring through the radial extension of the hub to the rotary pump shaft.

According to a further feature of the invention, the end zone of the radial extension of the hub has an axially extending rim oriented toward the slide ring seal. As a result of this feature, the end zone of the radial extension laterally shrouds the counterring protecting the latter like a housing and improving the stability of the impeller.

Radially between the axial rim and the counterring an elastomer ring is press-fitted to function as a static seal. This arrangement ensures that the counterring is securely positioned and held in the impeller. This arrangement is particularly advantageous in case the counterring is of a ceramic material, since the counterring is exposed solely to compression.

BRIEF DESCRIPTION OF THE DRAWING

The sole FIGURE is an axial sectional view of a symmetrical half of a preferred embodiment of the invention.

DESCRIPTION OF THE PREFERRED EMBODIMENT

Turning the FIGURE, there is illustrated therein an impeller-and-seal unit generally designated at 1. The unit includes an impeller 2 made of a synthetic material. A shell-like metal hub 3 is embedded in the impeller 2 and is arranged to receive an end portion of a pump shaft 8. The unit further has a slide ring seal assembly whose counterring 4 is connected with the impeller 2 and whose slide ring 5 is, by virtue of a coil spring 6, urged against the counterring 4 and received in a seal housing 11. The latter is fixedly held in a pump housing 9 of a liquid pump not illustrated in more detail.

According to the invention, the metal hub 3 has a radial extension 10 projecting radially outwardly from the outer edge zone of the hub 3. The radial extension 10 which is preferably an annular collar forming, with the hub, a single-piece component, is received in a central circular recess 7 of the impeller 2 and forms the bottom of the recess 7. The counterring 4 is accommodated in the recess 7 and is, with an end face **4*a* in a heat conducting contact with the radial hub extension 10. The radially outer end zone of the extension 10 is axially bent in a direction towards the slide ring 5 to thus form an axial rim 13 which laterally extends over the counterring 4 as well as a static sealing ring 12 for shrouding these parts in a housing-like manner. The static sealing ring 12 is radially compressed between the rim 13 and the counterring 4, whereby the latter is immobilized by friction forces in the recess 7. The direct connection between the hub 3 with the shaft 8 results in an optimal removal of heat from the counterring 4 and from the zone of the impeller 2, thus preventing any melting of the plastic impeller 2**.

It will be understood that the above description of the present invention is susceptible to various modifications, changes and adaptations, and the same are intended to be comprehended within the meaning and range of equivalents of the appended claims.

What is claimed is:

1. In an impeller-and-seal unit for a liquid pump, including a plastic impeller, a metal hub affixed to the impeller and arranged to receive and contact a pump shaft, a slide ring seal assembly including a slide ring and a counterring being in sliding contact with the slide ring and having an end face oriented away from said slide ring; the improvement comprising (a) means defining a central recess in said impeller; said counterring being received in the recess; and (b) a metallic radial extension having a radially outer end and being formed on said hub and projecting radially outwardly therefrom; the extension being received in the recess and forming a bottom thereof; said end face of said counterring being in a direct contact with said extension;

(c) a rim formed on the radially outer end of said extension and laterally surrounding said counterring; and (d) a static elastomer sealing ring received in said recess and press-fitted between said rim and said counterring, whereby the sealing ring and the counterring are immobilized in the impeller.

2. An impeller-and-seal unit as defined in claim 1, wherein the radial extension is an annular collar projecting from the hub.

3. An impeller-and-seal unit as defined in claim 1, wherein said rim projects axially from said radial extension.

* * * * *